United States Patent [19]

Havrilla

[11] Patent Number: 4,946,044

[45] Date of Patent: Aug. 7, 1990

[54] AERATION SEPARATOR

[75] Inventor: John R. Havrilla, Danville, Pa.

[73] Assignee: Kennedy Van Saup Corporation, Danville, Pa.

[21] Appl. No.: 195,719

[22] Filed: May 18, 1988

[51] Int. Cl.[5] ..... B07B 4/00

[52] U.S. Cl. ..... 209/474; 209/20; 209/138; 209/477; 209/495; 209/502

[58] Field of Search ..... 209/466, 467, 468, 471, 209/472, 486, 495, 496, 494, 474, 475, 491, 20, 477, 502, 138, 139.1

[56] References Cited

U.S. PATENT DOCUMENTS

| | | | |
|---|---|---|---|
| 1,194,477 | 8/1916 | Chevalier et al. | 209/467 |
| 1,509,909 | 9/1924 | Stebbins | 209/474 |
| 1,579,660 | 4/1926 | Reilly | 209/20 |
| 1,919,303 | 7/1933 | Raw | 209/502 |
| 2,273,296 | 2/1942 | Stump | 209/475 |
| 2,408,810 | 10/1946 | Puening | 209/474 X |
| 3,166,383 | 1/1965 | Morris | 209/466 X |
| 3,464,553 | 9/1969 | Hancock | 209/467 |
| 4,741,443 | 5/1988 | Hanrot et al. | 209/467 X |

FOREIGN PATENT DOCUMENTS

| | | | |
|---|---|---|---|
| 2258904 | 9/1975 | France | 209/474 |
| 442835 | 7/1975 | U.S.S.R. | 209/466 |
| 1242055 | 8/1971 | United Kingdom | 209/474 |

*Primary Examiner*—Donald T. Hajec

*Attorney, Agent, or Firm*—Brumbaugh, Graves, Donohue & Raymond

[57] ABSTRACT

An aeration separator for separating lighter and heavier materials in a separation chamber in which the material flows through a downwardly sloping passage in the lower region of the separation chamber toward a lower discharge while air flows upwardly through the material to aerate and agitate it to separate the lighter particles and direct them to an upper discharge.

14 Claims, 3 Drawing Sheets

AERATION SEPARATOR

BACKGROUND OF THE INVENTION

This invention relates to an aeration separator for separating lighter and heavier particles of dry powdered materials by means of fluidization.

The aeration separator of the present invention utilizes the upward flow of air through a stream of the dry powdered feed material moving through a separation chamber to separate different specific gravities and particle sizes within the feed material. The lighter and smaller particles are separated from the moving stream and are carried by the flow of air to the upper region of the separation chamber to an upper discharge, while the heavier and larger particles remain with or resettle in the moving stream which is removed from the separation chamber through a lower discharge.

Although the present invention has general application to separation of lighter and heavier particles from dry powdered materials, the present invention has particular application to the separation of hydrated lime from uncalcined limestone, the separation of sodium carbonate from potash and similar applications.

SUMMARY OF THE INVENTION

The aeration separator of the present invention includes a separation chamber having an inlet at an upstream end for the feed material to be separated and upper and lower discharges at a downstream end for removing the separated lighter and heavier particles, respectively, from the separation chamber. The lower region of the separation chamber has a downwardly sloping passage which extends from the inlet to the lower discharge from which the heavier particles are removed from the separation chamber. As the stream of material flows along the downwardly sloping passage, an upward flow of air through the stream of material separates the lighter particles and carries them upwardly through the separation chamber to the upper discharge through which the lighter particles are removed from the separation chamber. Although some of the air is discharged along with the lighter particles, the greater portion of the air is vented from the top of the separation chamber.

The separation chamber is preferably defined by substantially parallel upper and lower walls to maintain a bed of material of uniform depth within the separation chamber from the upstream to the downstream ends of the chamber. Moreover, the sidewalls of the chamber which extend from the upstream to the downstream ends are preferably sloped upwardly toward each other to increase the velocity of the upward flow of air and carry the lighter particles toward the upper discharge at an accelerated rate and at the same time impede the upward flow of heavier particles and return and resettle them in the stream of heavier particles moving toward the lower discharge.

In a preferred embodiment of the present invention the bottom of the separation chamber is defined by a downwardly sloping porous floor across which the dry powdered material flows by gravity. An air chamber, to which air is supplied under pressure, is located beneath the porous floor to provide a relatively uniform upward flow of air through the porous floor and the stream of material moving along it in a downstream direction to separate the lighter particles from the stream and direct them upwardly to the upper discharge while the stream in the downwardly sloping passage moves toward the lower discharge.

Although the downstream flow of feed material through the lower region of the separation chamber and the discharge of the heavier particles therefrom may be accomplished by gravity, the flow may be facilitated and directed by downstream directed air jets and/or by a grid made up of parallel bars extending above the porous floor from the inlet to the lower discharge of the separation chamber. The downstream flow can be further facilitated by imparting vibration to the grid.

DESCRIPTION OF THE DRAWINGS

For an understanding of the present invention, reference can be made to the detailed description which follows and to the accompanying drawings, in which.

DESCRIPTION OF THE PREFERRED EMBODIMENTS

Figure 1:
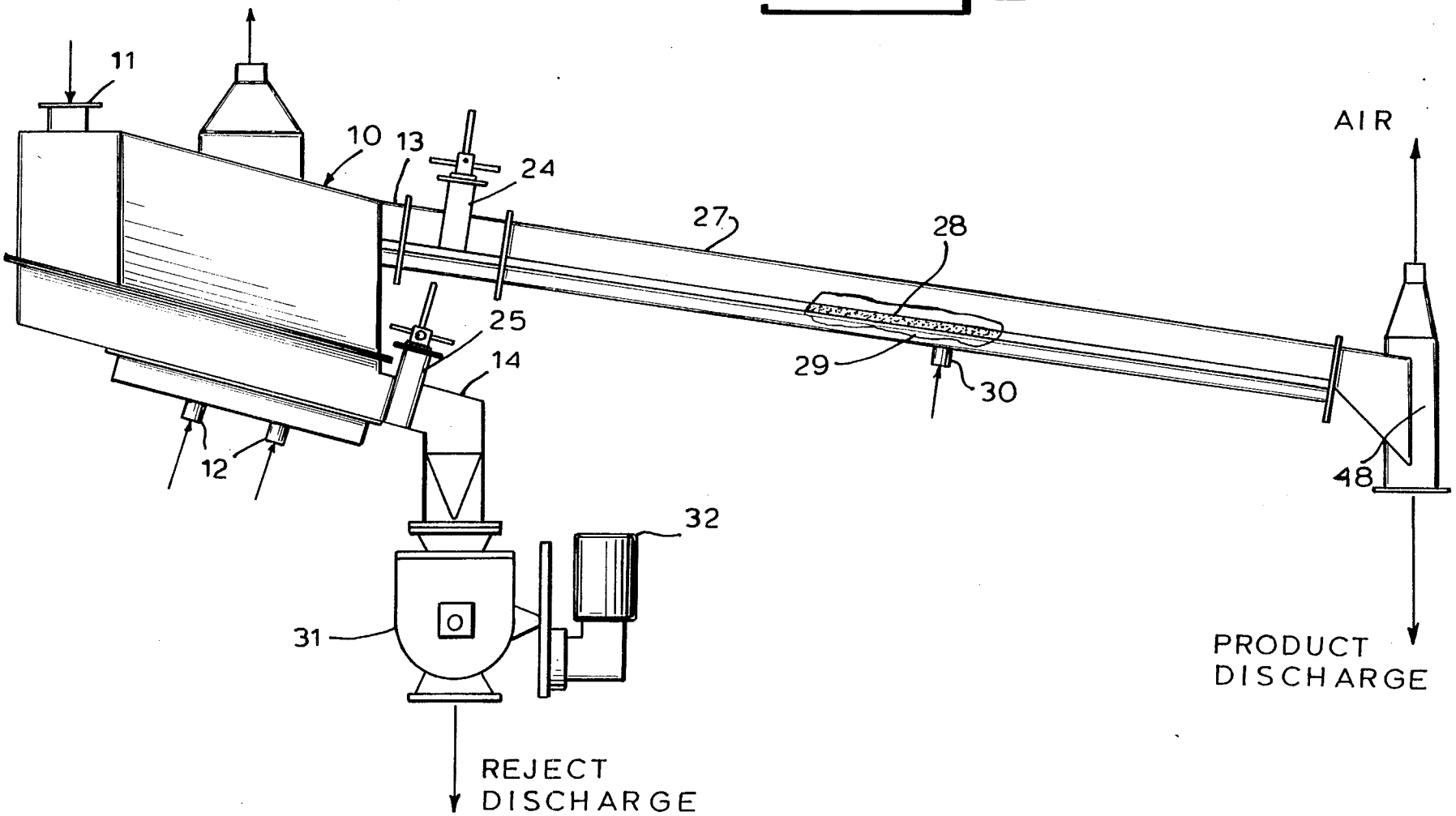
FIG. 1 is a side elevation showing an aeration separator assembly embodying the present invention.

The aeration separator assembly of the present invention, as shown in FIG. 1, includes an aeration separator 10 having an inlet 11 for a feed material composed of a mix of particles of different sizes and weights, air inlets 12 for the introduction of air into the aeration separator, an upper discharge 13 for the lighter particles and a lower discharge 14 for the heavier particles.

Figure 2:
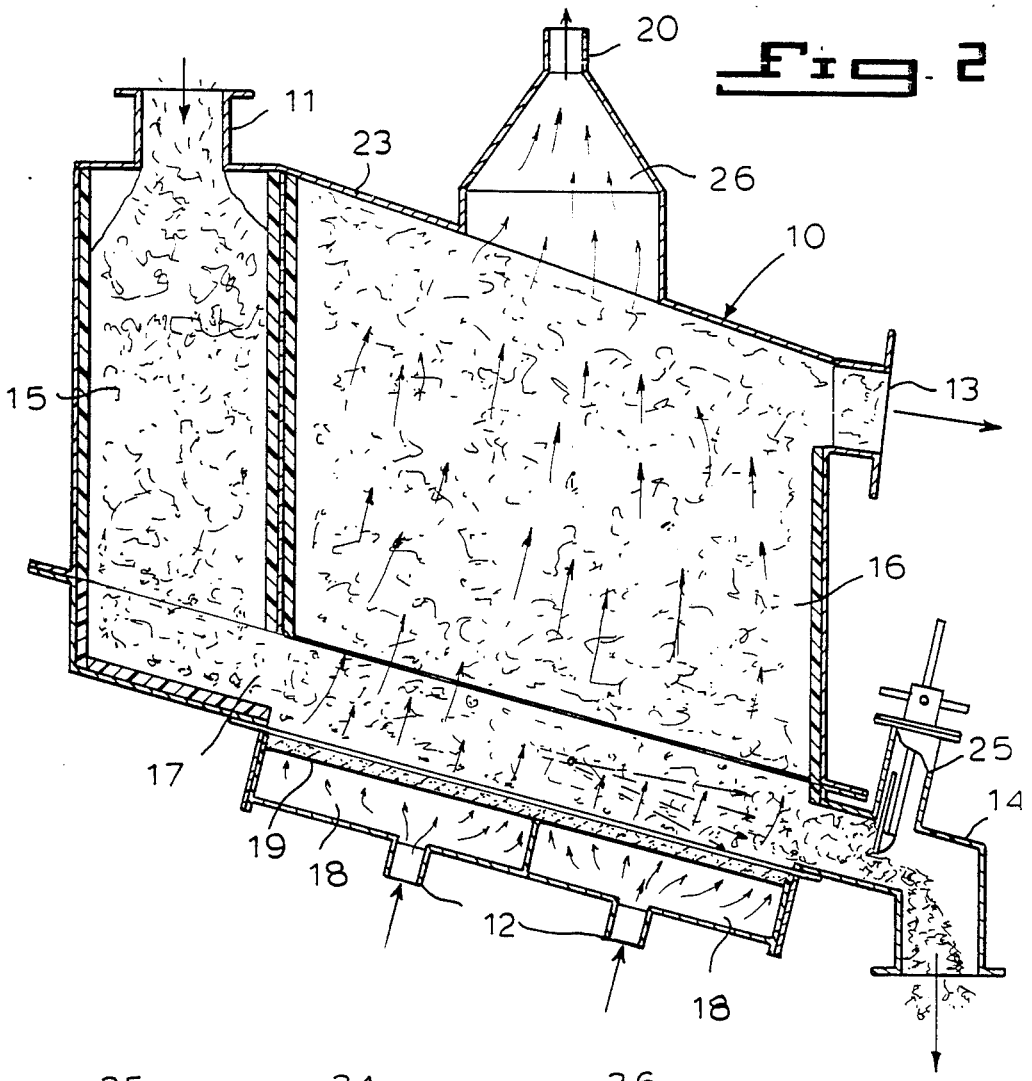
FIG. 2 is a sectional elevation showing the interior of the aeration separator.

The aeration separator 10, as best shown in FIG. 2, includes a feed chamber 15, a separation chamber 16, a passage 17 connecting the lower regions of the feed chamber and separation chamber to provide an inlet for the feed material into the separation chamber, air chambers 18 beneath a lower sloping porous wall or floor 19 of the separation chamber and an air vent 20 communicating with the upper region of the separation chamber.

The feed material introduced into the inlet 11 flows downwardly within the feed chamber to the passage 17 through which the feed material is introduced into the separation chamber. As the feed material flows along the downwardly sloping passage across the porous wall or floor 19 and toward the lower discharge 14, air from the chambers 18 passes upwardly through the porous floor and through the stream of feed material. The air volume and pressure are regulated to produce bubbling in and agitation of the bed. When sufficient air and pressure are introduced to the bed, the air velocity is higher than the cohesive forces of the particles, forming upwardly moving air bubbles in the mix, which agitates the mix sufficiently to permit separation of the finer and lighter particles from the heavier and larger particles. The lighter and finer particles are carried upwardly toward the upper discharge 13, while the heavier and larger particles continue to flow through the downwardly sloping passage in the lower region of the separation chamber to the lower discharge 14.

Figure 4:
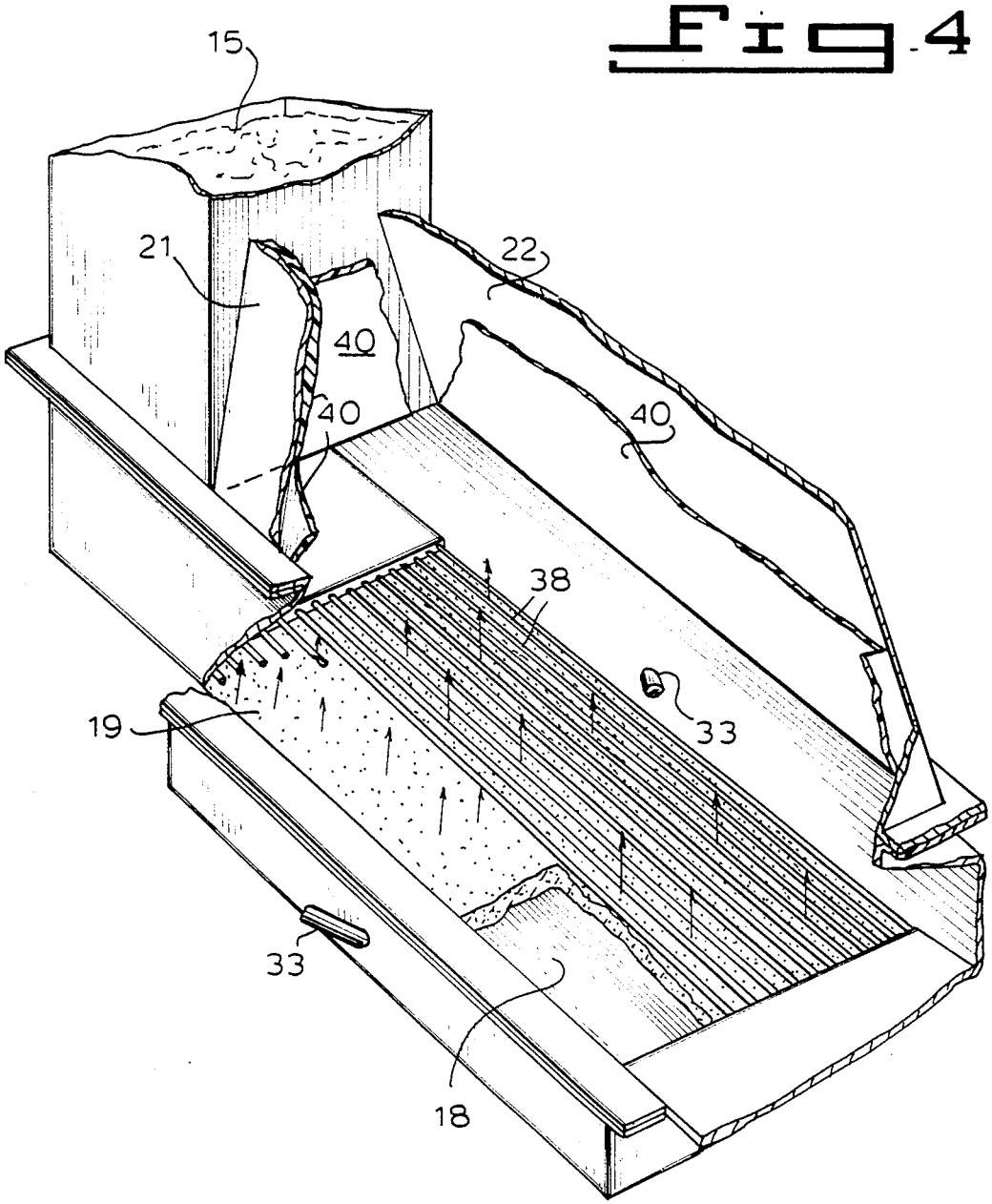
FIG. 4 is an isometric view of the lower region of the aeration separator.

The separation chamber is preferably designed with opposite side walls 21 and 22, shown in FIG. 4, which slope upwardly toward each other and by an upper wall 23, shown in FIG. 2, which is substantially parallel with the lower porous wall or floor 19. The sloping side walls cause an increase in air velocity, which allows the lighter and finer particles to be carried upwardly at an accelerated rate, while at the same time placing an obstacle in the path of the heavier particles. The lighter and finer particles travel upwardly at a high velocity to the upper discharge 13, even though they may hit the inner sloping surfaces of the side walls. However, the heavier and larger particles do not move at a velocity sufficient to overcome the force of hitting the sloped side walls and drop back into the stream flowing toward the lower discharge 14.

The bottom and top walls 19 and 23, respectively, are preferably parallel and slope downwardly from the upstream to the downstream ends of the separation chamber to maintain a bed of uniform depth throughout the length of the separation chamber. This is important because air will follow the path of least resistance, and if the upper wall 23 extended horizontally, the decreased depth of the bed would produce greater concentration of upward flow of air through the aeration chamber at the upstream end, which may result in stagnation of the material at the downstream end. The sloping bottom wall, as explained above, allows the heavier and larger particles to be removed from the aeration chamber by the lower discharge 14. As new material is fed into the aeration separation chamber, it helps displace the heavier particles along the downwardly sloping passage to the lower discharge 14.

The discharge of the finer and lighter particles from the upper discharge 13 is controlled by an adjustable gate 24 which permits the retention time of the material in the device to be regulated. An adjustable gate 25 in the lower discharge 14 also provides a control for the rate of discharge of the heavier and larger particles.

Although some of the air is entrapped and discharged with the lighter particles, most of the air flows upwardly and is discharged from the separation chamber through the vent 20. The upper region of the separation chamber communicates with the vent 20 through an upwardly extending chamber 26 through which the air travels at relatively low velocity so that any particles carried by the air into the chamber 26 will tend to drop back into the separation chamber.

The product from the upper discharge 13 the separation chamber flows, in an airstream through a downwardly sloped air-float conveyer 27 to a centrifugal separator 48, from which the air is discharged from the upper end and product is discharged from the lower end. The product is displaced through the conveyor 27 above a porous wall 28, for example, one similar to the porous wall 19 within the separation chamber, by air introduced into an air chamber 29 beneath the wall 28 via an air inlet 30. The air supplied to the upper region of the conveyor 27 through the porous wall carries the product to the separator 48.

The heavier material removed from the separation chamber through the lower discharge 14 passes through a rotary feeder 31 driven intermittently by a motor 32. The rotary feeder 31 provides an airlock for the reject material and permits regulation of the retention time of the flow of material within the separation chamber and the rate of the discharge therefrom.

Figure 3:
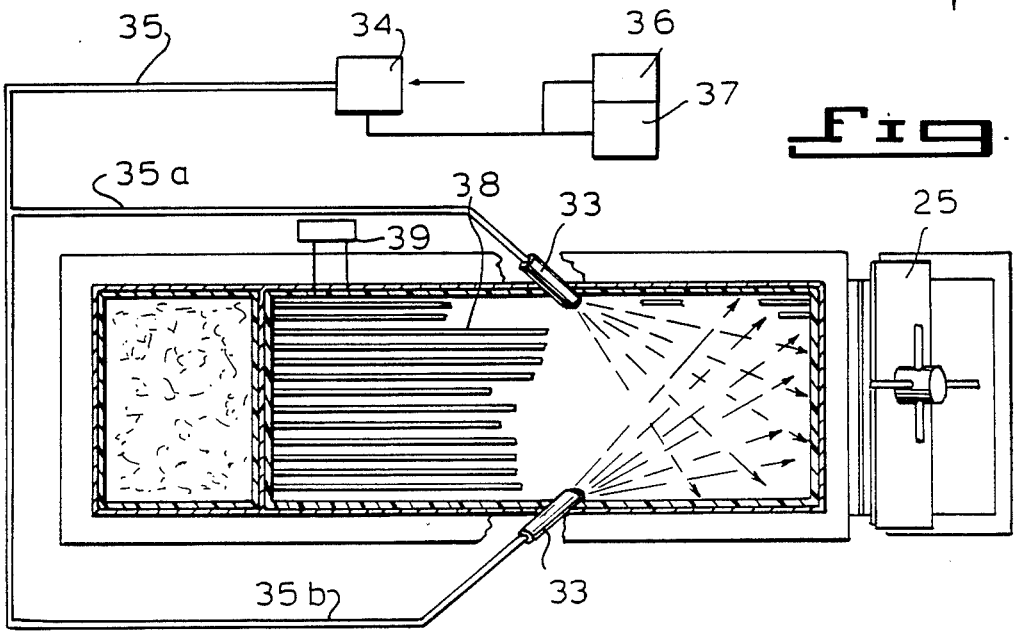
FIG. 3 is a sectional view showing the lower region of the aeration separator.

In processing material of larger particle size, the material may require assistance in moving along the sloped floor 19 toward the lower discharge 14. Toward this end, as shown in FIGS. 3 and 4, air jets 33 can be provided on both sides of the downwardly sloping passage in the lower region of the separation chamber to displace the heavier and larger material toward the discharge 14. As shown in FIG. 3, air is supplied through a control valve 34 and conduits 35, **35*a* and 35*b* to the air jets 33. The control valve, in turn, can be operated intermittently by an "on" timer 36 and an "off" timer 37 to activate and deactivate the air directed by the air jets against the heaver particles to displace them toward the discharge 14**.

It may also be desirable to provide a grid formed of a plurality of parallel bars 38 to facilitate and direct the movement of the larger particles toward the discharge 14, reduce the friction between the particles and the porous floor 19 and facilitate the aeration of the bed of the material in the downwardly sloping passage and the upward flow of air into the separation chamber. The parallel bars of the grid are spaced above the porous wall or floor 19 and extend from the upstream to the downstream ends of the downwardly sloping passage in the lower region of the separation chamber. A vibrator 39, shown schematically in FIG. 3, can be connected to the grid to agitate the material and help displace it toward the discharge 14.

The porous walls 19, 28 should permit the passage of a high volume of air, offer minimum resistance to the flow of material and not be susceptible to blockage of the air passages by the particles. The walls can be made of various materials, such as porous ceramic materials and woven polyester materials. In the separation of hydrated lime from uncalcined limestone, a porous ceramic floor 19 downwardly sloped at an angle of about 15° has been successfully used.

The walls of the separation chamber are preferably covered with polyethylene liner 40, as shown in FIG. 4, to prevent the materials from adhering to and building up on the walls. A window (not shown) is preferably provided in one of the sloped side walls 21, 22 to observe the bed depth and agitation level within the separation chamber, and an access door (not shown) is provided in the other side wall to facilitate cleaning the chamber.

The aeration separator can be used for the separation of material with 16 mesh X O with at least 70% passing 100 mesh and 50% passing 200 mesh with assurance that the material can be aerated without use of the air jets 33 or the grid bars 38. The air jets and grid bars can be used separately or in combination for material that will not move by gravity towards the bottom discharge. In some instances where agglomerations of product material are present in the feed material, a hammer mill can be used to break up the material (particularly agglomerations above 15 mesh), before introduction into the aeration separator.

The invention has been shown in preferred form and by way of example, and many variations and modifications can be made therein without departing from the spirit of the invention. The invention, therefore, is not to be limited to any specified form or embodiment except insofar as such limitations are expressly set forth in the claims.

I claim:

1. An aeration separator for separating lighter and heavier particles comprising a separation chamber having lower and upper regions and upstream and downstream ends, the lower region accomodating the flow by gravity of heavier particles and the upper region accomodating the flow of airborne lighter particles, an inlet at the upstream end for the particles to be separated, a discharge from the upper region at the downstream end for the lighter particles, a discharge from the lower region at the downstream end for the heavier particles, a downwardly sloping passage in the lower region of the separation chamber, an upper wall defining the chamber and a flow passage in the upper region of the chamber for the flow of the airborne lighter particles toward the discharge from the upper region, an air source for introducing air into the lower region of the separation chamber for upward flow through the particles in the downwardly sloping passage in the lower region of the separation chamber to separate the lighter particles and direct them to the discharge from the upper region as the heavier particles flow through the downwardly sloping passage to the discharge from the lower region, and an air vent communicating with the upper region of the separation chamber through said upper wall to vent air from the chamber.

2. An aeration separator as set forth in claim 1 including side walls defining the separation chamber sloping upwardly toward each other to increase the velocity of the upward flow of air and lighter particles while obstructing the upward flow of the heavier particles and returning them to the downwardly sloping passage in the lower region of the separation chamber.

3. An aeration separator as set forth in claim 1 in which said downwardly sloping passage is defined in part by a downwardly sloped lower wall along which the material flows toward the discharge from the lower region and in which said lower and upper walls of the chamber are substantially parallel.

4. An aeration separator as set forth in claim 3 including a low velocity chamber connecting the upper region of the separation chamber and the vent to return particles carried by the air to the separation chamber.

5. An aeration separator as set forth in claim 1 including a feed chamber for the feed material and having a lower discharge in communication with the inlet to the separation chamber.

6. An aeration separator as set forth in claim 1 in which said downwardly sloping passage is defined in part by a porous wall along which the material flows toward the lower discharge and including an air chamber in communication with the underside of the porous wall to introduce the air into the lower region of the separation chamber.

7. An aeration separator as set forth in claim 1 including an adjustable gate to regulate the rate of flow through the upper discharge.

8. An aeration separator as set forth in claim 1 including an adjustable gate to regulate the rate of flow through the discharge from the lower region.

9. An aeration separator as set forth in claim 1 including a centrifugal separator for separating air and product, an air conveyer connecting the upper discharge with the centrifugal separator and means for introducing air into the conveyer for flowing the product from the upper discharge to the centrifugal separator.

10. An aeration separator as set forth in claim 1 including an intermittently operated feeder in the discharge from the lower region to provide an airlock and regulate the rate of discharge from the discharge from the lower region.

11. An aeration separator as set forth in claim 1 including a downstream directed air jet in communication with the downwardly sloping passage in the lower region of the separation chamber to facilitate the displacement of the heavier particles toward the discharge from the lower region.

12. An aeration separator as set forth in claim 11 including means for intermittently supplying air to the downstream directed air jet.

13. An aeration separator as set forth in claim 1 including a grid of parallel bars within the downwardly sloping passage and extending from the inlet to the discharge from the lower region for facilitating and directing the flow of material toward the lower discharge.

14. An aeration separator as set forth in claim 13 including means for vibrating the grid.

* * * * *